US005738437A

United States Patent [19]

Ilagan

[11] Patent Number: 5,738,437

[45] Date of Patent: Apr. 14, 1998

[54] ATTACHMENT FOR LIGHT FIXTURE COVER

[76] Inventor: Artemio M. Ilagan, 346 Hernan Cortes, No. 6, Agana, Guam, 96934

[21] Appl. No.: 697,601

[22] Filed: Aug. 27, 1996

[51] Int. Cl.[6] ..... F21S 1/02

[52] U.S. Cl. ..... 362/363; 362/311; 362/375; 362/455

[58] Field of Search ..... 362/363, 375, 362/433, 453, 454, 455, 147, 311

[56] References Cited

U.S. PATENT DOCUMENTS

| | | | |
|---|---|---|---|
| 3,838,269 | 9/1974 | Bogdanovs | 362/363 |
| 3,974,373 | 8/1976 | Zapolsky | 362/363 |
| 4,099,224 | 7/1978 | Valpey | 362/433 |
| 4,175,282 | 11/1979 | Grindle et al. | 362/363 |
| 4,388,674 | 6/1983 | Sano | 362/363 |
| 4,520,435 | 5/1985 | Baldwin | 362/311 |
| 5,263,788 | 11/1993 | Moriel | 403/329 |
| 5,309,342 | 5/1994 | Heinen | 362/364 |
| 5,400,231 | 3/1995 | Huang | 362/455 |
| 5,491,618 | 2/1996 | Vakil | 362/147 |

FOREIGN PATENT DOCUMENTS

| | | |
|---|---|---|
| 864913 | 4/1961 | United Kingdom . |
| 1128189 | 9/1968 | United Kingdom . |

*Primary Examiner*—Alan Cariaso
*Attorney, Agent, or Firm*—Richard C. Litman

[57] ABSTRACT

An attachment configuration for securing a circular light fixture cover to a correspondingly configured light fixture base, includes an outwardly extending helical flange around the base of the cover and a mating helical channel within the light fixture base. Preferably, the flange and channel each form only a single pitch and extend around their respective components only 360 degrees, thereby allowing the fixture cover to be removed from or installed upon the fixture base with only a single turn. A stop may be provided in the assembly to prevent overtightening of the cover to the fixture base, and alignment markings may be provided to indicate the initial engagement point and fully engaged point of the cover relative to the base. The flange and mating channel may be provided on either of the components, and may be oriented inwardly or outwardly as desired, so long as the corresponding cover and fixture base have complementary and mating configurations. The system may be used to secure light fixture covers having convex shapes to mating fixtures, and may also be applied to flat covers for flush mounted fixtures. The present attachment system provides a tight fit between the cover and fixture base, thus precluding entry of insects or other small animals into the interior of the assembly. The attachment system is devoid of screws, clips, or any other components, and requires no tools or other equipment to install and remove the light cover to and from its corresponding light fixture base.

16 Claims, 5 Drawing Sheets

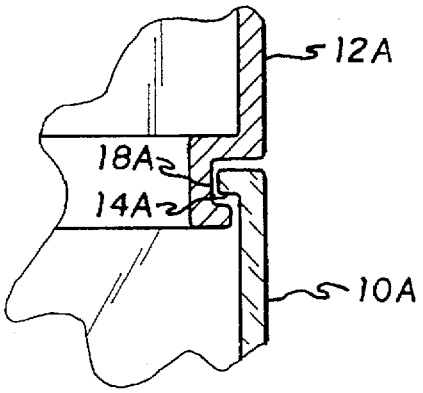
FIG. 5
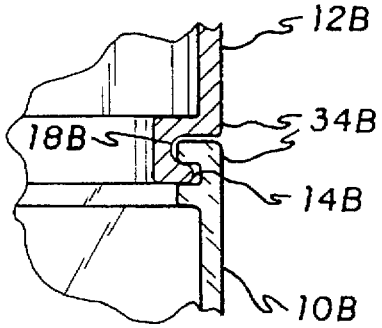
FIG. 6
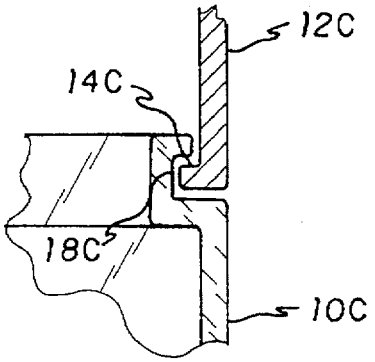
FIG. 7
FIG 8
PRIOR ART
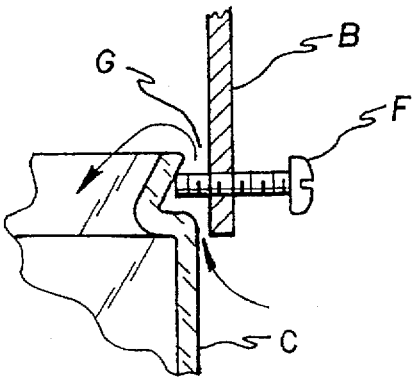
FIG. 9
PRIOR ART
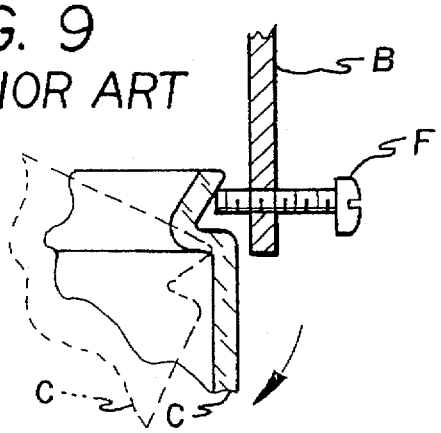

ATTACHMENT FOR LIGHT FIXTURE COVER

BACKGROUND OF THE INVENTION

1. Field of the Invention

The present invention relates generally to electrical illumination, and more specifically to an attachment means for a circular light fixture and cover therefor, wherein the fixture and cover are provided with a mating helical flange and groove, in the manner of a single pitch of mating threaded components. This attachment configuration provides numerous advantages over the conventional radial screws which capture a lip of the fixture cover. The present attachment is more secure and provides a better seal, serving to keep out insects and other small pests from the light fixture interior, and requires no tools or other equipment for the removal and replacement of the light fixture cover.

2. Description of the Prior Art

It has long been recognized that a light source requires some form of protection. This understanding extends back to lights provided by open flame (lanterns, etc.), where transparent or translucent enclosures were developed to protect other articles from the open flame, and to prevent the flame from being blown out by a draft or gust of wind. Typically, such covers were constructed in a three dimensional polygonal form, with flat poured glass panels set in a supporting frame of some sort.

Due to the non-circular configuration of the cover with its multiple flat panels, and the corresponding fixture base, the cover could not be turned relative to the base to secure the two components together. Accordingly, a plurality (generally three) of radially disposed screws were provided through the base, which would engage the base of the cover frame to secure the two components together where required. It will be noted that often, no attachment means at all was provided, as such open flame lighting required that the fixture and cover be oriented with the cover above the fixture base. Gravity would suffice to secure the cover atop the underlying fixture base for such lights, where it was unlikely that the cover would be inadvertently dislodged.

Shortly after the development of the incandescent electric light, it was realized that the light bulb itself, with its high heat output, fragile filament, and near vacuum enclosure, also required some protection from the elements in order to prolong its life span. Accordingly, various transparent and translucent covers, globes, and the like were developed. However, with the ability of the electric light to be mounted in any orientation, some means of removably attaching a depending fixture cover from an overhead fixture base was needed, and the same attachment means which was already known for earlier lighting principles, was used. Other attachment means (clips, etc.) were developed which also did not require the cover to be turned relative to the base, in order to provide for universal attachment for either circular or non-circular covers.

These light fixture covers generally have an outward flange extending completely around their bases, with the fixture having perhaps three or four threaded holes spaced about its periphery. Small screws are threaded into the holes and tightened, extending beneath the lip of the cover to preclude its removal from the fixture base. This fastening system is essentially the same system developed in the distant past, to secure a polygonal lantern cover having multiple panes to its underlying base, even though the vast majority of modern lighting fixtures include circular covers.

The above described means of securing a light fixture cover to a fixture base is serviceable, but has many disadvantages. Many such fixtures require a small screwdriver or other tool to turn the screws. Also, it is awkward to remove and reattach the cover from an overhead fixture, while trying to access the screws from around the sides of the fixture, which often has a larger diameter than its base. When the cover is secured, a gap will remain between the cover and fixture, allowing insects and such to enter the fixture. The small screws are easily cross threaded, resulting in resistance which feels as though the screw has been driven home, when actually no grip is being provided by the cross threaded screw. A fixture using only three screws for securing the fixture cover, results in the inability to secure the entire fixture cover when a single screw is lost, which can easily occur. The outwardly extending lip of such fixture covers invites misalignment, with the screw perhaps passing over, or into the edge of, the lip, again resulting in the loss of security by that screw and inability to secure the cover.

Perhaps as a result of the above described deficiencies of the conventional light fixture cover attachment means, other attachment means have been developed (e.g., clips, etc.), as will be noted in the discussion of the prior art following. However, to the knowledge of the present inventor, no one has developed a mating helical flange and channel configuration to secure a light fixture cover to its corresponding light fixture, with the accompanying advantages provided by such a configuration. A discussion of the prior art known to the present inventor, with its distinctions from the present invention, is provided immediately below.

U.S. Pat. No. 3,974,373 issued on Aug. 10, 1976 to Ira M. Zapolsky describes a Lamp Fixture having a specially formed base and cover. The cover is generally conventional, having an outwardly extending flange around the base thereof. The fixture base provides multiple locations for the mounting of a pair of opposed clips, which extend into the interior of the cover. Accordingly, the cover must have a larger internal diameter immediately within its opening, into which the clips may expand to secure the cover to the fixture base. Moreover, in at least one embodiment, Zapolsky specifically provides for the base of the cover to be spaced away from the interior of the fixture base. While the side of the fixture cover is adapted to fit closely against the fixture base wall, any looseness of the clips would result in a path for insects, etc. to enter the fixture cover. If a single clip is broken or lost, the cover cannot be replaced on the fixture base. The present invention overcomes these problems.

U.S. Pat. No. 4,099,224 issued on Jul. 4, 1978 to Lucy L. Valpey describes a Snap On Connection And Release Means Between Lightglobe And Fixture. Three evenly spaced, inwardly extending clips are provided about the fixture base rim, with the fixture cover or globe having a conventional outwardly extending flange about its base. The fixture cover is merely pushed into place, whereupon the retaining clips snap past the fixture cover flange to capture the flange within the fixture base. The cover is removed by turning in either direction, whereupon cams formed in the outer wall of the cover adjacent the flange, force the clips radially outwardly to allow the cover to be withdrawn. The arrangement provides some benefits over the conventional radially disposed screw retention method, but still allows a gap between the cover and base. Moreover, the loss or breakage of a single clip renders the assembly unusable. Also, if the cover is misaligned with the base by having the cams aligned with the clips, the cover will not be secured to the base, and no means is provided to determine this.

U.S. Pat. No. 4,520,435 issued on May 28, 1985 to Samuel L. Baldwin describes an Orientable Refractor Mounting, with a three piece arrangement. The fixture base accepts an adapter ring by means of a bayonet type mount, with a fixture cover having a snap fit to the adapter ring. The fixture cover may be turned relative to the adapter ring to orient the light output, as the cover is not threaded to the ring. The arrangement is essentially a continuous circumferential clip arrangement, and thus more closely related to the Zapolsky and Valpey devices than to the present invention.

U. S. Pat. No. 5,263,788 issued on Nov. 23, 1993 to Walter Moriel describes a Fastening Device For A Body, comprising a plurality of radial tabs which engage corresponding slots in the body. A ring is provided within the tabs, which may be moved axially to hold the tabs in their engaged position. While the Moriel disclosure notes that the apparatus may be used to secure a transparent body to another object, it is not clear whether or not he is referring to a cover for a light. The Moriel apparatus is apparently directed to a means of permanently securing a solid body (i.e., chandelier pendant) to the mounting point, and no means is apparent for accessing the locking ring for later removal of the body. No helically disposed fastening means is disclosed, as provided by the present attachment system.

U. S. Pat. No. 5,309,342 issued on May 3, 1994 to James J. Heinen, Sr. describes a Recessed Lighting Fixture incorporating a circular peripheral frame which holds a circular translucent plate for a flush mounted lighting fixture. The frame includes a plurality of tabs extending upwardly therefrom, which engage corresponding slots in the fixture body or reflector. The assembly provides for ease of removal and reinstallation of the cover relative to the base, but due to the fact that the cover frame will drop downwardly slightly when completely engaged with the base, due to the depending fingers of the tabs, the cover cannot seal tightly against the base to preclude the entry of insects and other small animals therein. This gap between cover and base is apparent in FIG. 7 of the Heinen, Sr. patent.

U.S. Pat. No. 5,491,618 issued on Feb. 13, 1996 to Usman Vakil describes a Light Fixture having a cover with an outwardly extending flange with three gaps formed therein. The gaps correspond to inwardly facing projections formed in the fixture base. The gaps of the cover are aligned with the protrusions of the base and turned, so the cover flange rides over the protrusions of the base. The flange appears to be planar, rather than helical, so no tightening action occurs as the cover is progressively turned onto the base, as in the present light fixture cover attachment.

British Patent Publication No. 864,913 published on Apr. 12, 1961 to Robbins & Bradley Ltd. describes Improvements In Electric Light Fittings, wherein a plurality of pivotable retainers is secured to the fixture base. A cover having an inwardly extending flange is pressed into position, and the edge contacts a finger on each of the retainers, causing the retainers to pivot outwardly to support the flange of the cover. The arrangement is relatively complex, with its numerous moving parts and spring means to hold the retainers in position, and no turning engagement is disclosed.

Finally, British Patent Publication No. 1,128,189 published on Sep. 25, 1968 to Phillips Electronic and Associated Industries Ltd. describes Improvements In Or Relating To Devices For Centering Elements Of An Optical System. The apparatus serves to fix a projector lamp magnetically within a reflector, and uses radially disposed screws to lock the alignment, as is known in the art.

None of the above inventions and patents, either singly or in combination, is seen to describe the instant invention as claimed.

SUMMARY OF THE INVENTION

Accordingly, it is a principal object of the invention to provide an improved means of removably attaching a light fixture cover to a light fixture base, by providing a single outwardly extending circumferential helical flange about the base of the cover, and a mating single inwardly disposed circumferential channel or groove about the mating portion of the fixture base, whereby the cover may be installed to or removed from the base with a single 360°degree turn.

It is another object of the invention to provide an improved light fixture cover attachment which provides a tight seal between the cover and the base, thereby precluding the entrance of insects and other small pests into the light fixture.

It is a further object of the invention to provide an improved light fixture cover attachment which may include stop means to prevent overtightening of the cover, and alignment means to indicate the starting point and fully engaged point of the cover with the fixture.

An additional object of the invention is to provide an improved light fixture cover attachment which cover may be either inwardly or outwardly disposed relative to the fixture base, and with either the cover or the base adaptable to having either the flange or the channel formed thereon.

Still another object of the invention is to provide an improved light fixture cover attachment which is adaptable for use with either flat or convex light fixture covers.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIGS. 5, 6, and 7 are fragmentary elevation views in section, showing alternative channel and flange arrangements.

FIGS. 8 and 9 are fragmentary elevation views of prior art light fixture cover attachment means, showing their deficiencies.

Similar reference characters denote corresponding features consistently throughout the attached drawings.

DETAILED DESCRIPTION OF THE PREFERRED EMBODIMENTS

The present invention comprises various embodiments of a light fixture base and transparent or translucent light fixture cover therefor, with the base and the cover having mating attachment means devoid of any and all other fasteners, clips, retainers, etc. Conventional light fixtures include a plurality of threaded holes evenly spaced about the rim of the fixture base, with screws being driven through each of the holes to clamp the edge of the fixture cover. While this system has served to secure light fixture covers to their fixture bases since before the manufacture of circular fixtures and covers, the clamp screw method, with its numerous disadvantages, has generally been carried over to the present day, as shown in the prior art FIGS. 8 and 9, with the exception of various clips and clamps which have been devised for the purpose.

Figure 1:
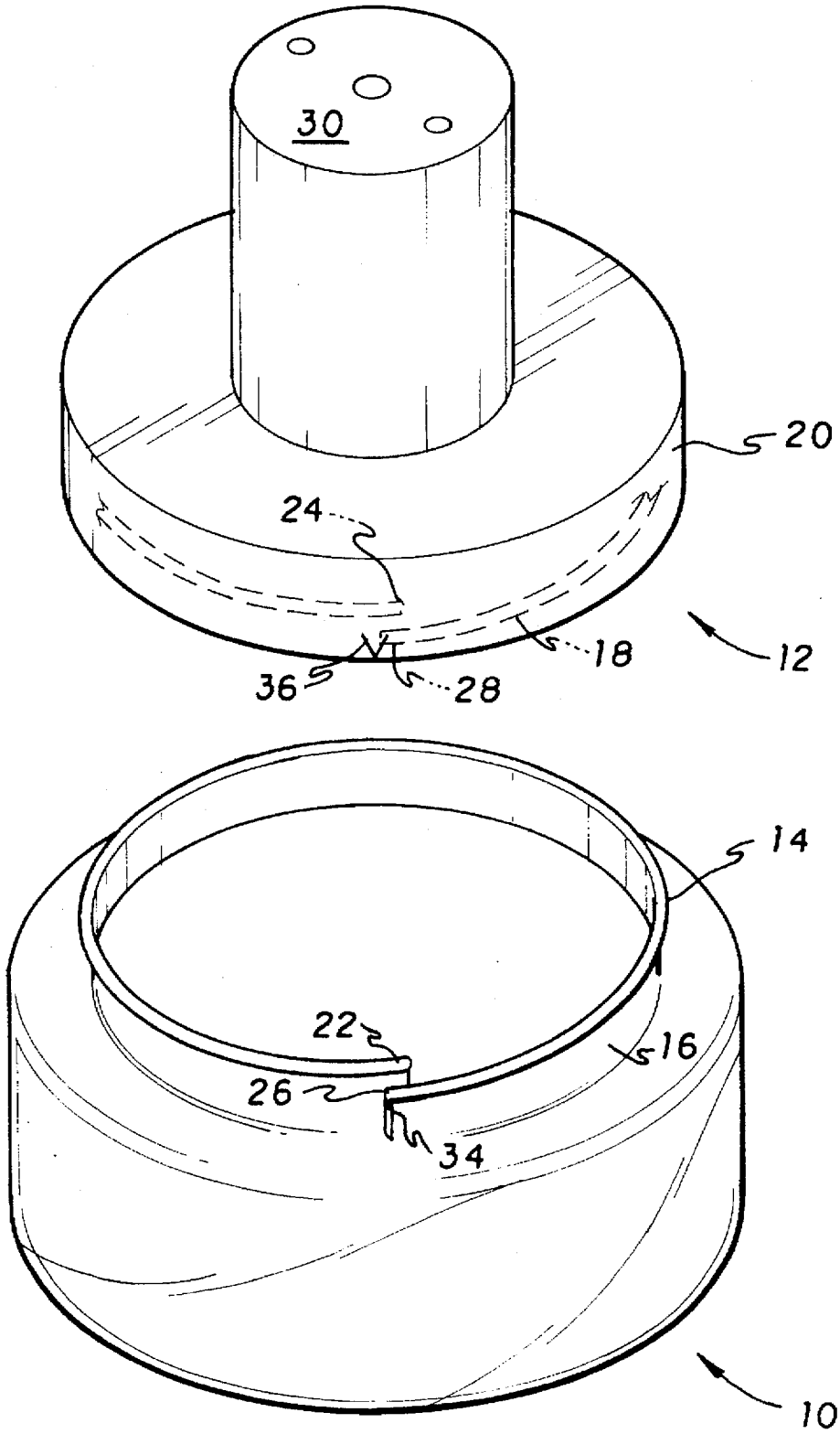
FIG. 1 is an exploded perspective view of a light fixture base and cover therefor, showing the external helical flange of the cover and the mating channel in the fixture base.

FIG. 1 provides an exploded perspective view of the present light fixture assembly, with its light fixture cover 10 and light fixture base 12. Rather than using screws, clips, clamps, and/or other hardware to secure the two components together, the cover 10 is provided with an outwardly extending flange 14 from its edge 16, with the base 12 including a channel 18 extending inwardly from its rim 20. As the typical light fixture cover is cast or otherwise formed of plastic or glass, the flange 14 (and other flange embodiments described further below) may be formed integrally with the cover, as a single unitary article. The fixture base may include the channel integrally formed in a like manner, particularly for fixture bases cast of plastic material.

The flange 14 and channel 18 each extend circumferentially about their respective cover edge 16 and base rim 20. Each has a helical configuration, with the leading ends of the flange 14 and channel 18, respectively 22 and 24, being displaced from their respective trailing ends 26 and 28 in the same direction, i. e., toward the mounting end 30 of the fixture base 12 when the cover 10 and base 12 are oriented for assembly. The channel 18 includes a space between the walls thereof which is only very slightly larger than the thickness of the flange 14, to provide a good seal between the cover 10 and the base 12, thus to preclude entry of insects and other small pests into the assembly when the two are assembled together. The cross sectional views of FIGS. 5, 6, and 7 show this close fit clearly, and it will be understood that the fit of the flange 14 and channel 18 respectively of the cover 10 and base 12 of FIG. 1, are of similar quality.

Preferably, the flange 14 and channel 18 each extend about their respective cover 10 and base 12 for only one pitch of their helical path, or substantially three hundred and sixty degrees. The spacing between the leading and trailing ends of the flange 14 and channel 18 is preferably no more than sufficient to allow for the thickness of one channel wall between the leading and trailing ends 22 and 26 of the cover flange 14, in order to provide a tight fit when the cover 10 is secured to the base 12 and to preclude excessive advance as the cover 10 is turned on to the base 12.

Figure 2:
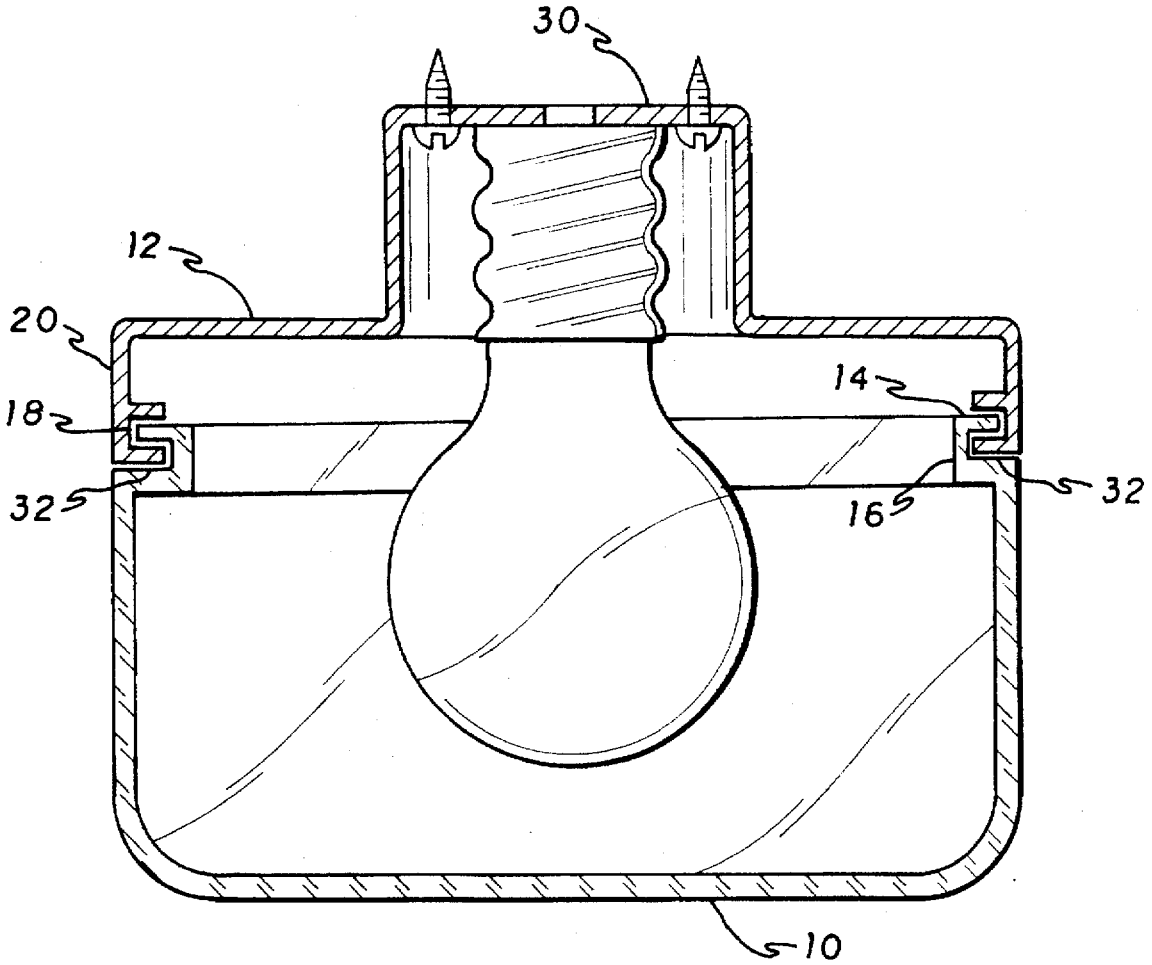
FIG. 2 is an elevation view in section of a light fixture cover and base assembly having a similar attachment configuration to that of the components of FIG. 1.

The cover 10 may be turned onto the base 12 until the face 32 of the cover edge 16 abuts the rim 20 of the fixture base 12, as shown in FIG. 2, assuming that the cover edge 16 has such an outwardly extending face 32 therebelow, as shown. This abutting contact between the cover 10 base 12 serves as a stop means to preclude excessive turning of the cover 10 onto the base 12, past the engagement of the flange 14 with the channel 18.

However, if such an abutting face 32 is not provided, some other form of stop means must be provided. Moreover, such abutting contact between two surfaces only slightly angularly displaced from the shallow helical orientation of the flange 14 and channel 18, can cause the cover face 32 and rim 20 to jam together and cause them to be excessively difficult to separate when desired. Thus, it may be desired to provide some other or additional stop means to preclude overtightening or jamming of the fixture cover 10 relative to the fixture base 12, as provided by the detent 34 disposed across the trailing end 26 of the cover flange 14, and shown in FIG. 1. When the cover 10 is turned onto the base 12, the detent 34 serves as a stop at the trailing end 26 of the flange 14, and contacts the trailing end 28 of the base channel 18 to prevent further advance of the flange 14 within the channel 18.

The stop means or detent 34 may be located at the leading end 24 of the channel 18 in the fixture base 12, if desired, to accomplish the same function. However, the location of the detent 34 on the outer surface of one of the fixture components, where it is visible, provides other benefits, described below.

While the three hundred sixty degree flange and channel engagement assures that no more than one full turn is required to secure the light fixture cover 10 to the light fixture base 12, it may be helpful to provide some means of indicating the alignment of the cover flange leading end 22 with the trailing end 28 of the fixture base channel 18. Accordingly, a first alignment indicator 36 (which may be in the form of a V mark, as shown in FIG. 1, or other mark, as desired) may be placed on the exterior of the base rim 20 at the trailing end 28 of the channel 18, which indicator mark 36 will align with the flange detent 34 at the trailing end 26 of the flange 14. The flange detent 34 thus serves a second function as the second alignment indicator for the fixture cover 10. Alternatively, a second indicator mark 38 may be placed on the cover 12 in addition to the detent 34, as shown in FIG. 3.

Aligning these two indicators 34/38 and 36 with one another allows the leading end 22 of the flange 14 to be positioned exactly at the trailing end 28 of the channel 18 as the cover 10 is started on the base 12, to reduce the need for excessive turning of the cover 10 to secure it to the base 12. After the cover 10 is turned through one complete revolution relative to the base 12 and the cover 10 is completely engaged with the base 12, the two alignment indicators 34/38 and 36 will once again be aligned with one another, with the second indicator and detent 34 serving as a stop to preclude excessive tightening of the fixture cover 10 onto the fixture base 12. FIG. 3 shows this arrangement, with an additional second alignment indicator 38 being provided.

Figure 3:
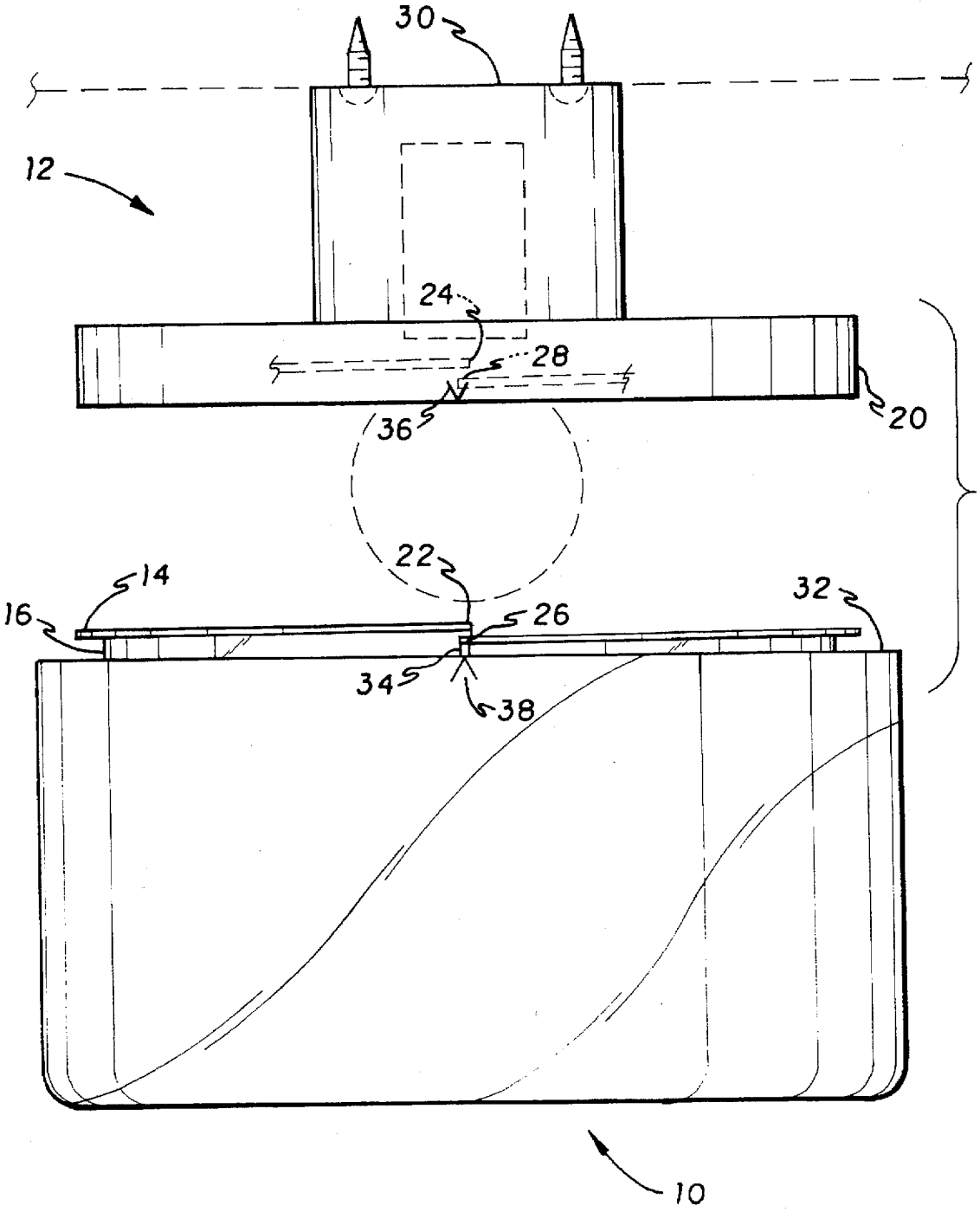
FIG. 3 is an exploded elevation view of the separated components of FIG. 2.
Figure 4:
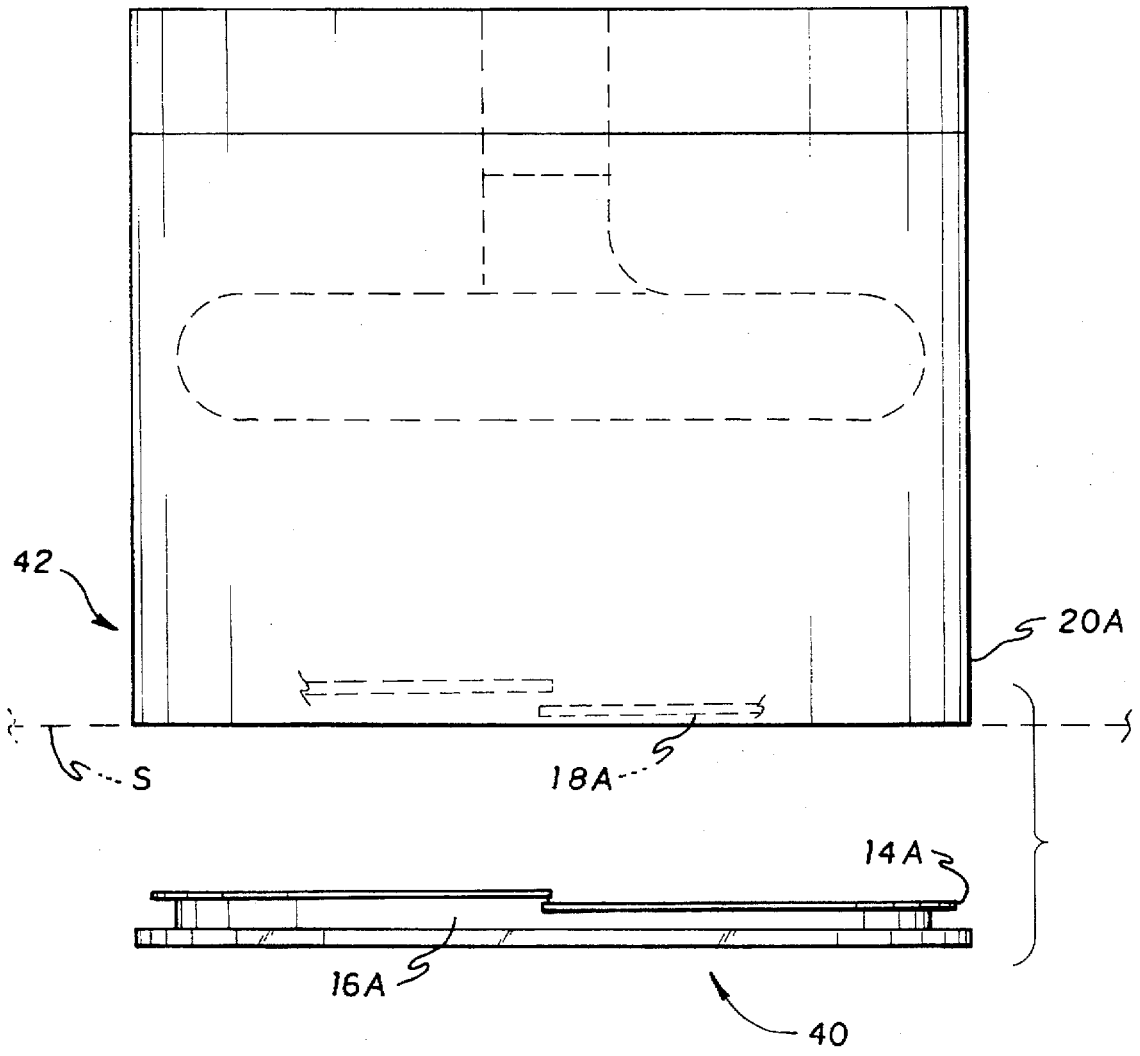
FIG. 4 is an exploded elevation view of a flush mounted light fixture base and flat cover therefor, showing their mating attachment means.

FIGS. 1 through 3 all disclose a convex light fixture cover 10, which is adapted to surround a light source which protrudes from a mating light fixture base 12. However, it will be seen that the present light fixture cover attachment means need not be limited to use with convex covers. FIG. 4 provides an exploded side elevation view of a flat light fixture cover 40 and corresponding recessed light fixture base 42. (It will be noted that a circular fluorescent tube is shown in broken lines in the recessed fixture base 42, but it will be understood that the present light fixture cover attachment means may be used with fixtures accommodating incandescent, fluorescent, or other lighting means, so long as the fixture base and cover are circular.)

The flat fixture cover 40 includes a raised edge **16*a*, similar to the edge 16 of the cover 10 of FIGS. 1 through 3, with a flange 14*a* extending outwardly therefrom. The recessed fixture base 42 includes a rim 20*a*, with a channel 18*a* disposed therein. The external flange 14*a* of the flat cover 40 is adapted to engage the internal channel 18*a* of the recessed fixture base 42, in the manner of the flange 14 and channel 18 of the fixture cover 10 and base 12 of FIGS. 1 through 3. Alignment marks and stop means, not shown but essentially the same as those discussed further above and shown in FIG. 1 through 3, may be provided as desired. The configuration shown in FIG. 4 enables the flat cover 40 to be installed substantially flat with the adjacent surface S, without any requirement for protruding clamps, clips, screws, etc. A notch or other means (not shown) may be provided in the cover 40** for access.

To this point, the present invention has been described as having an outwardly disposed flange on the cover portion of the fixture, and an inwardly disposed channel in the base portion of the fixture. However, it will be seen that the channel may extend outwardly from the base portion, with the flange extending inwardly from the cover portion, if desired. The fragmentary elevation view in section of FIG. 5, shows such a configuration. In FIG. 5, the cover 10*a* has an inwardly extending flange 14*a*, which engages an outwardly facing channel 18*a* of the mating fixture base 12*a*. (While the fixture cover 10*a* and base 12*a* are not shown in their entireties, it will be understood that they are substantially similar to the fixture cover 10 and base 12 shown in FIGS. 1 through 3. The fixture cover 10*a* and base 12*a* of FIG. 5 may also be provided with stop means and alignment indication means, as in the fixture cover 10 and base 12 discussed further above.

Also, the flange and channel arrangement of the present invention may be reversed, with the cover portion being provided with a channel and the base portion being provided with a flange to mate with the cover channel. FIG. 6 provides a fragmentary elevation view in section of such a configuration, where the fixture cover 10*b* includes an inwardly facing channel 18*b* extending from its edge 16*b*, and the mating fixture base has an inset rim 20*b* with a flange 14*b* extending outwardly therefrom. These components engage one another similarly to the cover flange and base channel described further above, and similar additional features, such as a stop detent 34*b* and indicators (not shown) may be provided.

FIG. 7 provides a fragmentary elevation view in section of another alternative, where the cover 10*c* is provided with an outwardly facing channel 18*c* and the mating fixture base 12*c* has an inwardly facing flange 14*c* which is adapted to engage the channel 18*c* in a manner similar to that described further above for other embodiments of the present invention. Again, the fixture cover 10*c* and fixture base 12*c* are substantially similar to the cover 10 and base 12 of FIGS. 1 through 3, excepting the flange 14*c* and channel 18*c* configuration, and need not be shown in their entireties. It will be seen that the various features described further above, i. e., stop means and alignment indication means, may also be provided for the cover 10*c* and base 12*c* of FIG. 7, if desired. Any of the covers 10*a*, 10*b*, and/or 10*c* of FIGS. 5, 6, and 7 may be formed as a flat cover, if desired, by reducing the depth of the depending bowl, essentially as shown for the flat, planar cover 40 of FIG. 4.

In summary, the present attachment for a light fixture cover to a light fixture provides a much simpler and easier means of securing a fixture cover to a mating fixture base. The helical flange and channel arrangement disclosed in its various embodiments provides a neat, clean, and positive attachment for the cover to the fixture base, devoid of screws, clips, clamps, and other attachment hardware. The flange and channel structure is also easily formed in the fixture components at the time of manufacture, thereby reducing the overall cost of the fixture by eliminating any additional hardware.

The present attachment system also provides an excellent seal completely around the periphery of the joint between cover and base, unlike the conventional radially disposed screw attachment means shown in FIGS. 8 and 9. The need to provide space for engagement of the screw or fastener F, results in a gap G between the cover C and the base B, which gap is nonexistent with the present attachment system. (it will be understood that any gap apparent in FIGS. 2 and 5 through 7 is exaggerated for clarity in the drawings.) Also, the partial disengagement of a single screw or fastener F can result in the entire cover C slipping from its position in the overlying base B, as shown in FIG. 9. Partial engagement of the present attachment system (e.g., only a half turn of engagement between cover and base) will still result in a substantial engagement between channel and flange, and serve to secure the cover to the base to an adequate degree.

Thus, the present attachment system serves to overcome the numerous deficiencies of the prior art attachment systems, and particularly the radial screw attachment means which has been handed down since the earliest days of lanterns, lamps, and other enclosed illumination devices. The present system is economical to manufacture, easy to assemble and disassemble, and provides a tight, secure fit between fixture cover and fixture base, to prolong the life of the light element and maintain cleanliness.

It is to be understood that the present invention is not limited to the sole embodiment described above, but encompasses any and all embodiments within the scope of the following claims.

I claim:

1. A circular light fixture assembly, including:

a light fixture base having a rim including a circumferential helical channel formed therearound, said channel having a leading end and an opposite trailing end; and a light fixture cover removably attachable to said base, said cover having an edge including a circumferential helical flange formed therearound, said flange of said cover being configured to fit closely with said channel of said base and to seal tightly therewith when said flange of said cover is completely engaged with said channel of said base, said flange having a leading end and a trailing end, said trailing end of said flange having a detent formed thereacross, said detent contacting said trailing end of said channel when said flange of said cover is completely engaged with said channel of said base thereby precluding said cover from rotating further with respect to said base, said base and said cover being devoid of additional means providing for the attachment of said cover to said base.

2. The light fixture assembly according to claim 1, wherein:

said channel of said light fixture base extends inwardly from said rim of said base, and said flange of said light fixture cover extends outwardly from said edge of said light fixture cover.

3. The light fixture assembly according to claim 1, wherein:

said channel of said light fixture base extends outwardly from said rim, and said flange of said light fixture cover extends inwardly from said edge of said light fixture cover.

4. The light fixture assembly according to claim 1, wherein said detent precludes said cover from rotating more than three hundred sixty degrees during engagement with said fixture base.

5. The light fixture assembly according to claim 1, including:

alignment means disposed upon said fixture base and said fixture cover, with said alignment means being aligned when said channel of said base and said flange of said cover are completely engaged with one another.

6. The light fixture assembly according to claim 5, wherein said alignment means comprises a first alignment indicator disposed upon said rim of said fixture base, and a second alignment indicator comprising said detent of said trailing end of said flange of said fixture cover, with said first alignment indicator and said second alignment indicator being aligned with one another when said channel of said base and said flange of said cover are completely engaged with one another.

7. The light fixture assembly according to claim 1, wherein:

said light fixture cover has a generally convex shape.

8. The light fixture assembly according to claim 1, wherein:

said light fixture cover is substantially flat and planar.

9. A circular light fixture assembly, including:

a light fixture base having a rim including a circumferential helical flange formed therearound, said flange having a leading end and an opposite trailing end, said leading end of said flange including a detent formed thereacross;

a light fixture cover removably attachable to said base, said cover having an edge including a circumferential helical channel formed therearound, with said channel of said cover being configured to fit closely with said flange of said base and to seal tightly therewith when said channel of said cover is completely engaged with said flange of said base, said channel having a leading end and an opposite trailing end, said detent contacting said leading end of said channel when said channel of said cover is completely engaged with said flange of said base thereby precluding said cover from rotating further with respect to said base, said base and said cover being devoid of additional means providing for the attachment of said cover to said base.

10. The light fixture assembly according to claim 9, wherein:

said flange of said light fixture base extends inwardly from said rim of said base, and said channel of said light fixture cover extends outwardly from said edge of said light fixture cover.

11. The light fixture assembly according to claim 9, wherein:

said flange of said light fixture base extends outwardly from said rim, and said channel of said light fixture cover extends inwardly from said edge of said light fixture cover.

12. The light fixture assembly according to claim 9 wherein said detent precludes said cover from rotating more than three hundred sixty degrees during engagement with said fixture base.

13. The light fixture assembly according to claim 9, including:

alignment means disposed upon said fixture base and said fixture cover, with said alignment means being aligned when said channel of said cover and said flange of said base are completely engaged with one another.

14. The light fixture assembly according to claim 13, wherein said alignment means comprises a first alignment indicator disposed upon said edge of said fixture cover, and a second alignment indicator comprising said detent of said leading end of said flange of said fixture base, with said first alignment indicator and said second alignment indicator being aligned with one another when said channel of said cover and said flange of said base are completely engaged with one another.

15. The light fixture assembly according to claim 9, wherein:

said light fixture cover has a generally convex shape.

16. The light fixture assembly according to claim 9, wherein:

said light fixture cover is substantially flat and planar.

* * * * *